US006444266B1

(12) United States Patent
Mizuno

(10) Patent No.: US 6,444,266 B1
(45) Date of Patent: Sep. 3, 2002

(54) BUILDING PANEL AND MANUFACTURING METHOD THEREOF

(75) Inventor: Daizo Mizuno, Nagoya (JP)

(73) Assignee: Nichiha Co., Ltd., Nagoya (JP)

( * ) Notice: Subject to any disclaimer, the term of this patent is extended or adjusted under 35 U.S.C. 154(b) by 0 days.

(21) Appl. No.: 09/668,369

(22) Filed: Sep. 25, 2000

(30) Foreign Application Priority Data

Oct. 15, 1999 (JP) ..... 11-293471

(51) Int. Cl.[7] ..... B05D 1/28

(52) U.S. Cl. ..... 427/258; 427/260; 427/262; 427/267; 427/269; 427/428

(58) Field of Search ..... 427/258, 260, 427/262, 267, 269, 287, 428; 15/230, 230.13; 52/316

(56) References Cited

U.S. PATENT DOCUMENTS 3,434,862 A * 3/1969 Luc
4,201,801 A * 5/1980 Hori
5,779,610 A * 7/1998 Weihrauch

FOREIGN PATENT DOCUMENTS

| | | |
|---|---|---|
| JP | 9-99261 | 4/1997 |
| JP | 2667100 | 6/1997 |

* cited by examiner

*Primary Examiner*—Fred J. Parker
(74) *Attorney, Agent, or Firm*—Oblon, Spivak, McClelland, Maier & Neustadt, P.C.

(57) ABSTRACT

A method for manufacturing a building panel with which a satisfactory three-dimensional effect can be easily imparted to a designed surface thereof, the designed surface including concave and convex portions. The method for manufacturing the building panel, obtained by forming a dot-coating layer on a designed surface, includes the steps of transferring a dot-presenting paint onto the designed surface for forming a plurality of dots via a transfer roll, the transfer roll having a plurality of protruding portions on a roll surface in order to form the dot-coating layer, wherein the plurality of dots are formed so that areas of the dots are varied through differences in pressurizing force applied by the protruding portions onto the designed surface.

9 Claims, 10 Drawing Sheets

BUILDING PANEL AND MANUFACTURING METHOD THEREOF

BACKGROUND OF THE INVENTION

1. Field of the Invention

The present invention relates to a method for manufacturing a building panel obtained by forming a dot-coating layer on a designed surface including concave and convex portions as well as to a building panel manufactured through this manufacturing method.

2. Description of the Related Arts

A conventionally known method for imparting a three-dimensional effect to a designed surface of a building panel is a method in which groove-like joint portions are arranged, wherein these joint portions and protruding portions formed between these joint portions are painted with different colors (so-called two-tone coating).

Such a method is carried out, for instance, by first applying a paint of a color designed for the joint portions over the entire designed surface through spraying, and by applying a paint of a different color is applied thereafter only on the protruding portions by using a roll coater.

It is also suggested for a building panel that comprises concave and convex portions also on the protruding surfaces for imparting more superior three-dimensional effects and high-grade-looking effects.

However, the following problems are known in performing coating on designed surfaces of building panels.

In case protruding surfaces further comprise concave and convex portions as in the above-noted case, it is only partially possible to perform coating when using an ordinary roll coater.

On the other hand, in the field of printing, there is a method to perform gradational expression in which the color is successively changed from deep to pale. For enhancing concave and convex portions on protruding surfaces, the method to change the color successively from deep to pale in approaching from the convex portions towards the concave portions can be considered. With this method, three-dimensional effects of the concave and convex portions of the protruding surfaces can be enhanced through shading effects obtained thereby.

However, it is difficult to gradually change the amount of applied paint by using an ordinary roll coater, and it is thus difficult to achieve a gradational expression. Further, in trying to achieve a gradational expression through an inkjet coating method, it is difficult to achieve a desired gradational expression since the protruding surfaces are not flat but comprise concave and convex portions.

SUMMARY OF THE INVENTION

The present invention has been made in view of the above conventional problems, and it is an object thereof to provide a method for manufacturing a building panel with which a satisfactory three-dimensional effect can be easily imparted to a designed surface thereof that comprises concave and convex portions, and to provide a building panel manufactured thereby.

The present invention is a method for manufacturing a building panel obtained by forming a dot-coating layer on a designed surface thereof that comprises concave and convex portions, the method comprising the steps of transferring a dot-presenting paint onto the designed surface for forming a plurality of coated dots by means of a transfer roll formed with a plurality of protruding portions on its roll surface in order to form the dot-coating layer, wherein the plurality of coated dots is formed so that areas of the coated dots are varied through differences in pressurizing force applied by the protruding portions onto the designed surface.

This and other objects, features and advantages of the present invention will become more apparent upon a reading of the following detailed description and drawings.

DETAILED DESCRIPTION OF THE INVENTION

Figure 1A:
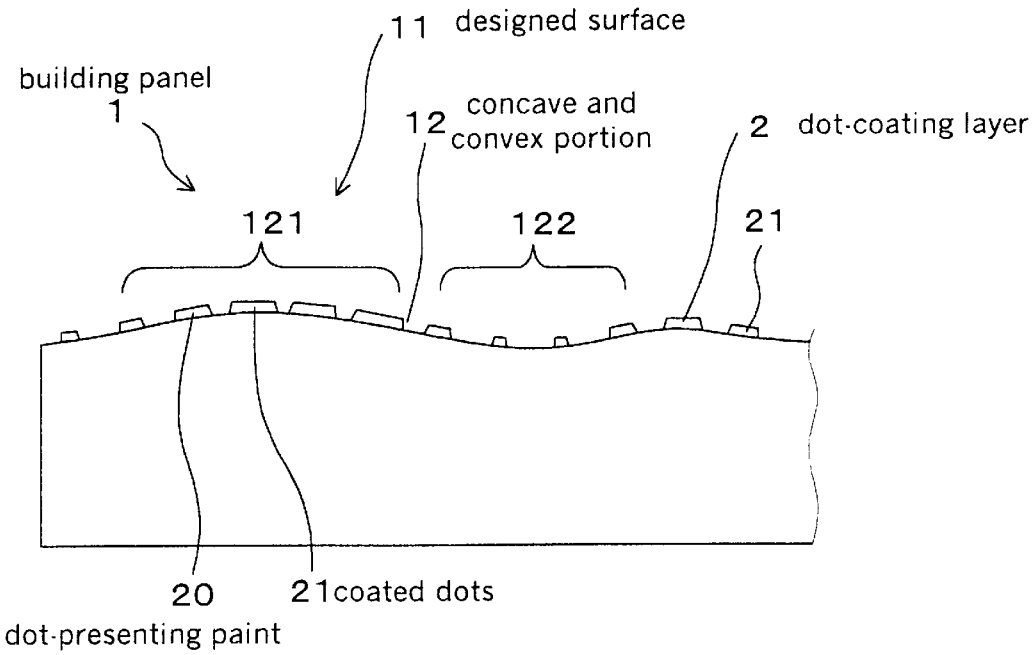
FIG. 1A is a sectional view and FIG. 1B a plan view of a building panel formed with a dot-coating layer according to Embodiment 1.

The most notable point of the present invention is that a plurality of coated dots can be applied such that areas of these coated dots are varied through differences in pressurizing force applied by the protruding portions onto the designed surface.

Each coated dot comprises a dot formed of dot-presenting paint that is transferred on the designed surface of the building panel through a single protruding portion on the transfer roll. The dot-coating layer is formed by the aggregation of each of these coated dots.

The concave and convex portion has an uneven surface such as a surface of a rock.

The actions and effects of the present invention will now be explained.

For forming the dot-coating layer on the building panel, dot-presenting paint is applied while pressurizing the protruding portions of the transfer roll onto the designed surface. At this time, the pressurizing force applied by the protruding portions onto the designed surface varies between portions of the designed surface owing to the concave and convex portions formed on the designed surface. More concretely, the pressurizing force is large at convex portions of the desingned surface and the pressurizing force is small at concave portions thereof.

Thus, coating is performed in the present invention such that areas of the coated dots are varied through differences in pressurizing force. For instance, contact areas between protruding portions on the transfer roll and the designed surface are varied through differences in pressurizing force whereby the transferred areas of the coated dots are varied.

Accordingly, the areas of coated dots are large at convex portions and the areas of coated dots are small at concave portions. Thus, the designed surface appears an external appearance in which the color of the dot-presenting paint is deep at convex portions and becomes gradually paler in approaching the concave portions.

At this time, by employing a dot-presenting paint of bright color (for instance, of pale-colored type) and a deep color as a color for the undercoat layer (for instance, of deep-colored type), it is possible to achieve a gradational expression with the convex portions being bright whereas the color becomes gradually deeper approaching the concave portions. In this manner, it is possible to enhance the concave and convex portions to thereby achieve a designed surface exhibiting satisfactory three-dimensional effects.

By making a building panel including concave and convex portion on its designed surface pass among the transfer roll, a back-up roll and so forth, which are installed facing the transfer roll, the pressurizing force is naturally and partly varied as to enable gradational expression. Thus, no particular control for varying the pressurizing force needs to be performed at each of the portions while still presenting three-dimensional effects in an easy manner.

In this manner, the present invention is capable of providing a method for manufacturing a building panel which satisfactory three-dimensional effects being imparted to a designed surface thereof that includes concave and convex portions.

It is preferable that the plurality of protruding portions on the transfer roll be of substantially identical shapes and of identical size and be further arranged at substantially identical intervals.

Owing to the substantially same shapes and same sizes of the protruding portions, differences in pressurizing force applied by the protruding portions onto the designed surface almost directly corresponds to the differences in areas of coated dots.

Since the protruding portions are arranged at substantially identical intervals, large-sized areas of the coated dot almost directly correspond to the deepening of the color of the dot-presenting paint at these portions.

Accordingly, it is enabled to enhance concaves and convexes of the designed surface by reliably performing gradational expression in accordance with concave and convex portions of the designed surface and to reliably present three-dimensional effects.

It should be noted that it is preferable to set the substantially identical shapes, identical sizes and substantially identical intervals in the range of 95% to 105% with respect to average values.

It is preferable that the number of protruding portions formed per inch on the roll surface be 60 to 70, wherein an area ratio of upper surfaces of the protruding portions be 15 to 25% of the roll surface, and wherein a height of the protruding portions be 400 to 500 $\mu$m.

In this manner, it is possible to impart satisfactory three-dimensional effects to the designed surface through natural gradational expression.

In case the number of protruding portions formed per inch of the roll surface is less than 60, the dot-coating layer cannot be satisfactorily formed with the coated dots being coarse such that three-dimensional effects may not be presented. On the other hand, in case number of protruding portions exceeds 70, the coated dots will be too fine such that three-dimensional effects may not be presented either.

Further, in case the area ratio of the protruding portions is less than 15%, the dot-coating layer cannot be satisfactorily formed such that three-dimensional effects may not be presented. On the other hand, in case the area ratio of the protruding portions exceeds 25%, the amount of coating will be too excessive, resulting in unsatisfactory variations in areas of coated dots owing to differences in pressurizing force such that three-dimensional effects may not be imparted to the designed surface either.

In case the height of the protruding portions is less than 400 $\mu$m, variations in areas of coated dots owing to differences in pressurizing force are unsatisfactory such that three-dimensional effects may not be imparted to the designed surface. On the other hand, it may be similarly the case that satisfactory three-dimensional effects may not be presented in case the height of the protruding portions exceeds 500 $\mu$m.

It should be noted that the number of protruding portions formed per inch on the roll surface is determined by counting the number of straight lines (slanted lines of a broken line Y—Y in FIG. 3A) consisting of successively arranged protruding portions between a width of 1 inch.

The transfer roll preferably comprises an inner layer elastic portion and an outer layer elastic portion with a higher hardness than that of the inner layer elastic portion.

In this manner, it is possible to reliably perform gradational expression in accordance with concave and convex portions of the designed surface. It should be noted that the inner layer elastic portion and the outer layer elastic portion are made, for instance, of rubber material.

It is further preferable that the hardness of the inner layer elastic portion be 15 to 30 degrees and the hardness of the outer layer elastic portion 65 to 75 degrees.

In this manner, it is possible to perform gradational expression in accordance with concave and convex portion of the designed surface in an even more reliable and uniform manner.

A hardness of the inner layer rubber of less than 15 degrees is too soft and may cause difficulties in operating the transfer roll. On the other hand, in case the hardness of the inner layer rubber exceeds 30 degrees, it may happen that performances for accommodating inconsistencies in thickness of panels are degraded.

Varying the pressurizing force of the protruding portions may become difficult in both cases in which the hardness of the outer layer elastic portion is either less than 65 degrees or above 75 degrees.

It should be noted that the values for the hardness of the inner layer rubber and the outer layer rubber are those measured by using a C-type testing machine in conformity to JIS K 6301-1995 "Vulcanized Rubber Physical Testing Method".

It is further preferable that the dot-presenting paint have a viscosity of 0.02 to 0.03 Pa·s.

With this preparation, coated dots formed by transferring the dot-presenting paint are maintained at transferred positions without flowing and also maintaining transferred sizes and shapes. Thus, it is possible to reliably impart desired three-dimensional effects to the designed surface.

The dot-presenting paint that has been transferred onto the designed surface may flow in case the viscosity is less than 0.02 Pa·s. On the other hand, in case the viscosity exceeds 0.03 Pa·s, it may be that the dot-presenting paint may not be transferred by satisfactory amounts.

It should be noted that the above values of viscosity have been measured by using a rotating viscometer.

The designed surface may comprise groove-joint portions in addition to concave and convex portions having the dot-coating layer. With this arrangement, a building panel having the designed surface being imparted with more superior three-dimensional effects can be manufactured.

On the joint portions, protruding portions of the transfer roll are not pressurized, therefore dot-presenting paint is not transferred and the dot-coating layers are not formed.

In a method for manufacturing a building panel, the method comprises the steps of forming an undercoat layer by spraying an undercoat paint over the entire surface of the designed surface of the building panel, forming an intermediate coat layer by spraying an intermediate coat paint on the undercoat layer, forming a dot-coating layer by applying a dot-presenting paint on the intermediate coat layer at the concave and convex portions by using the transfer roll, and forming a clear layer by spraying a clear paint on the entire surface of the designed surface thereafter (see FIGS. 7A to 7D).

With this arrangement, it is possible to present three-dimensional effects through the intermediate coat layer and the dot-coating layer. More particularly, the dot-coating layer exhibits the actions and effects as described in the explanations for the above invention, and three-dimensional effects can be achieved by the combination thereof with the intermediate coat layer.

In a method for manufacturing a building panel, the method comprises the steps of forming an undercoat layer by spraying an undercoat paint over the entire surface of the designed surface of the building panel, forming an intermediate coat layer by spraying an intermediate coat paint on the undercoat layer, forming an upper coat layer by applying an upper coat paint on the intermediate coat layer at the concave and convex portions through roll coating, forming a dot-coating layer by applying a dot-presenting paint on the upper coat layer by using the transfer roll, and forming a clear layer by spraying a clear paint on the entire surface of the designed surface thereafter (see FIGS. 9A to 9E).

Roll coating of the upper coat paint is performed by using an ordinary coating roll with no particular protruding portions being formed on the roll surface thereof.

In this case, the color of the joint portions of the designed surface is comprised by the intermediate coat layer while the gradation of the concave and convex portion appears in the upper coat layer and the dot-coating layer.

In this manner, it is possible to manufacture a building panel having a designed surface with even superior three-dimensional effects being imparted thereto.

A building panel may be obtained by forming a dot-coating layer on a designed surface thereof that includes concave and convex portions, wherein the dot-coating layer comprises a plurality of coated dots with different areas, and wherein the area of coated dots of convex portions in the concave and convex portions of the designed surface is larger than the area of coated dots of concave portions in the concave and convex portions.

According to the above building panel, the color of the dot-presenting paint is deep at the convex portions of the designed surface and becomes paler in approaching the concave portions. It is thus possible to obtain a building panel having a designed surface being imparted with satisfactory three-dimensional effects as explained above.

The designed surface should preferably be comprised with groove-like joint portions besides the concave and convex portions.

With this surface design, it is possible to manufacture a building panel with even superior three-dimensional effects being imparted to the designed surface thereof.

The building panel may be formed with a paint layer that comprises an undercoat layer and an intermediate coat layer sequentially provided over the entire designed surface of the building panel, a dot-coating layer provided on the intermediate coat layer of the concave and convex portions of the designed surface, and a clear layer provided on the entire surface of the designed surface.

With this arrangement, it is possible to present three-dimensional effects through the intermediate coat layer and the dot-coating layer.

The building panel may be formed with a paint layer that comprises an undercoat layer and an intermediate coat layer sequentially provided over the entire designed surface of the building panel, an upper coat layer and a dot-coating layer sequentially provided on the intermediate coat layer at the concave and convex portions of the designed surface, and a clear layer provided on the entire surface of the designed surface.

With this arrangement, it is possible to present three-dimensional effects on a designed surface thereof.

Namely, each color of the joint portions over the designed surface and the concave and convex portion can be different definitely. Accordingly, a three-dimensional effect appears clearly.

Embodiments

Embodiment 1

A building panel and a method for manufacturing the same according to one embodiment of the present invention will now be explained with reference to FIGS. 1A to 6B.

Figure 1B:
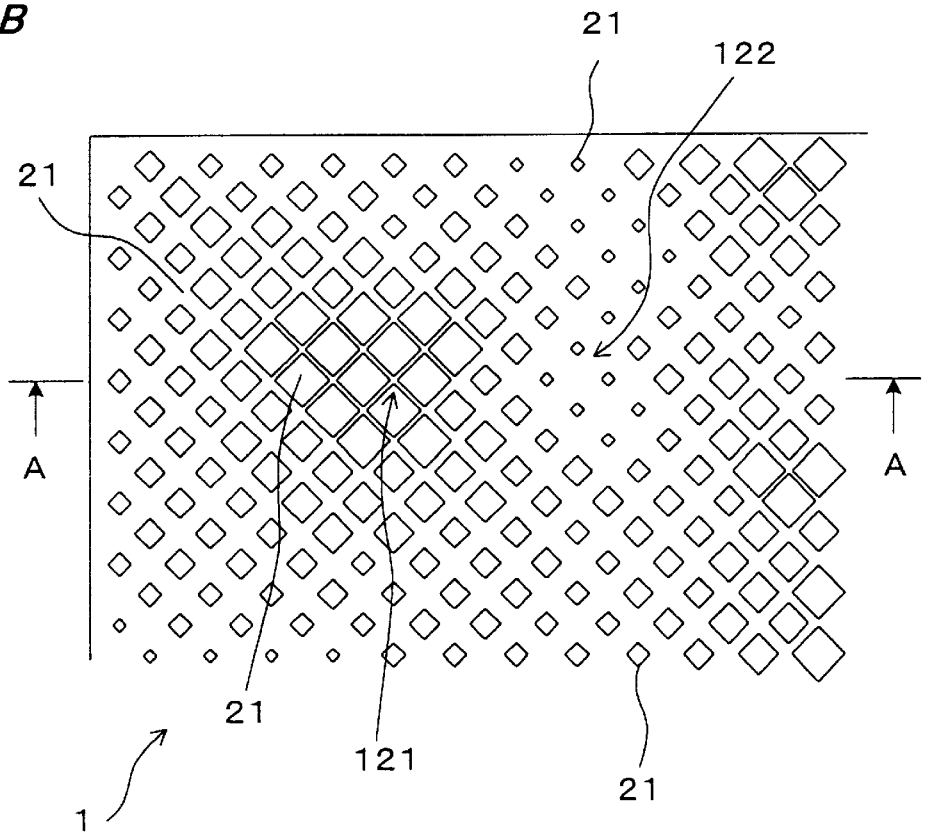

As illustrated in FIGS. 1A and 1B, building panel 1 of the present embodiment is a building panel of ceramic type obtained by forming a dot-coating layer 2 on a designed surface 11 formed with concave and convex portions 12. The dot-coating layer 2 comprises a plurality of coated dots 21 having differently sized areas.

The areas of these coated dots 21 are arranged in that those of convex portions 121 among the concave and convex portions 12 of the designed surface 11 are large while those of concave portions 122 among the concave and convex portions 12 are smaller as illustrated in FIGS. 1A and 1B.

The concave and convex portion has an uneven surface such as a surface of a rock.

It should be noted that FIG. 1A is a sectional view seen from a direction as indicated by the arrow at line A—A in FIG. 1B.

Figure 2:
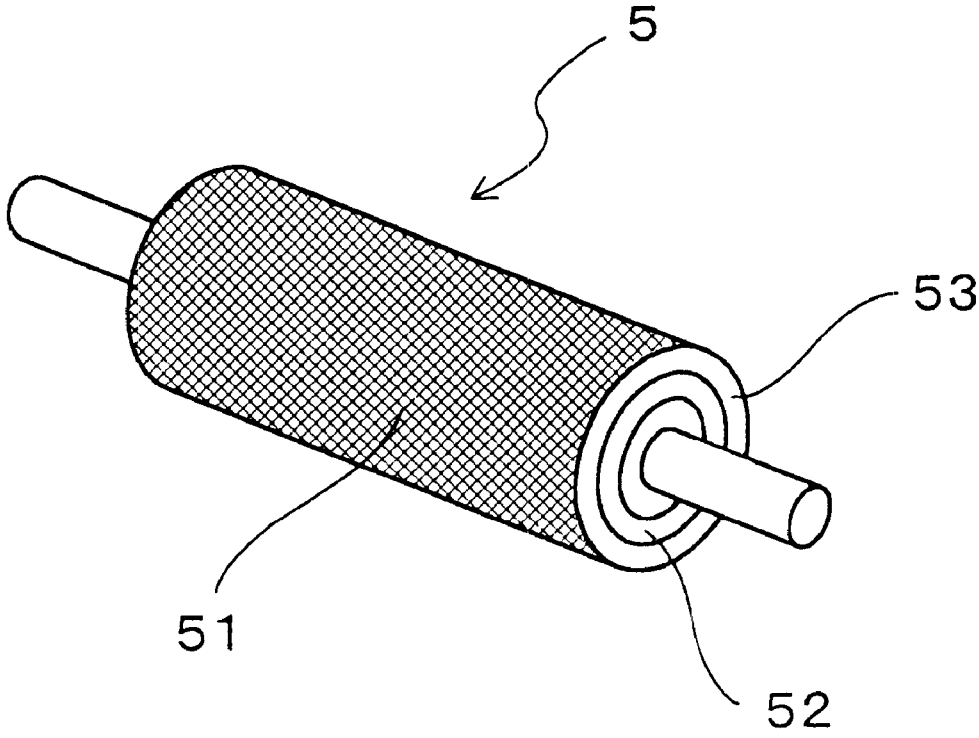
FIG. 2 is a perspective view of a transfer roll according to Embodiment 1.

A transfer roll 5 formed with a plurality of protruding portions 51 on a roll surface thereof as illustrated in FIGS. 2 and 3 is employed for forming the dot-coating layer 2. This transfer roll 5 is used for forming the plurality of coated dots 21 by transferring dot-presenting paint 20 onto the designed surface 11 (FIGS. 1A and 1B).

The plurality of coated dots 21 are coated such that areas of the coated dots 21 vary through differences in pressurizing force applied by the protruding portions 51 onto the designed surface 11.

Figure 3A:
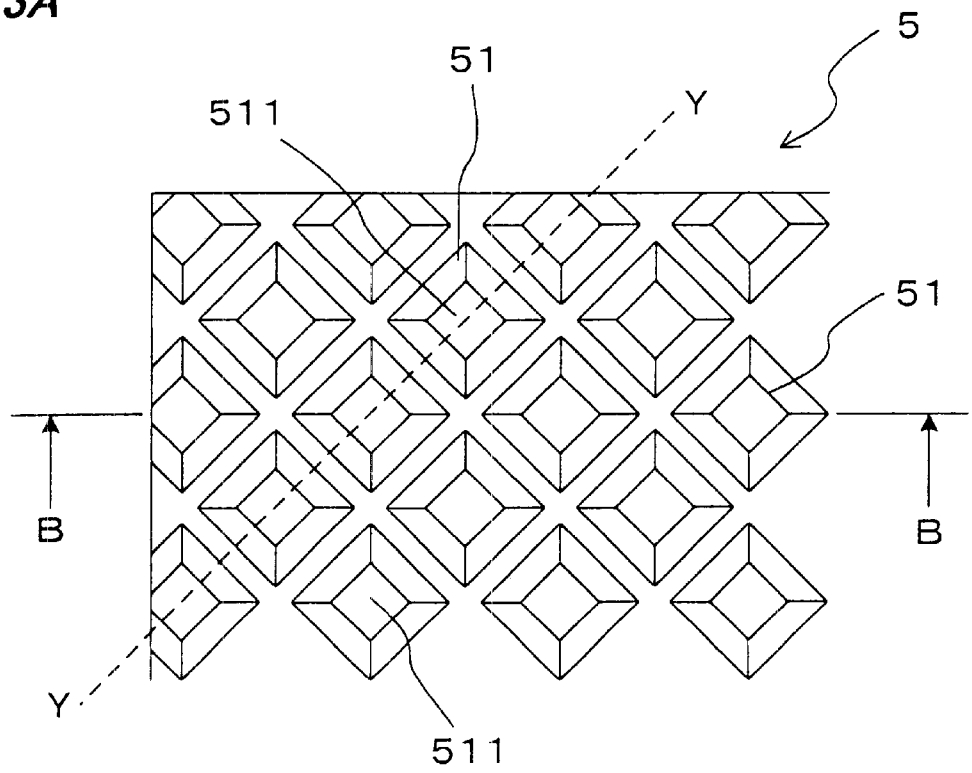
FIG. 3A is a plan view of a roll surface of the transfer roll according to Embodiment 1, and FIG. 3B a sectional view seen from a direction as indicated by arrow B—B of FIG. 3A.
Figure 3B:
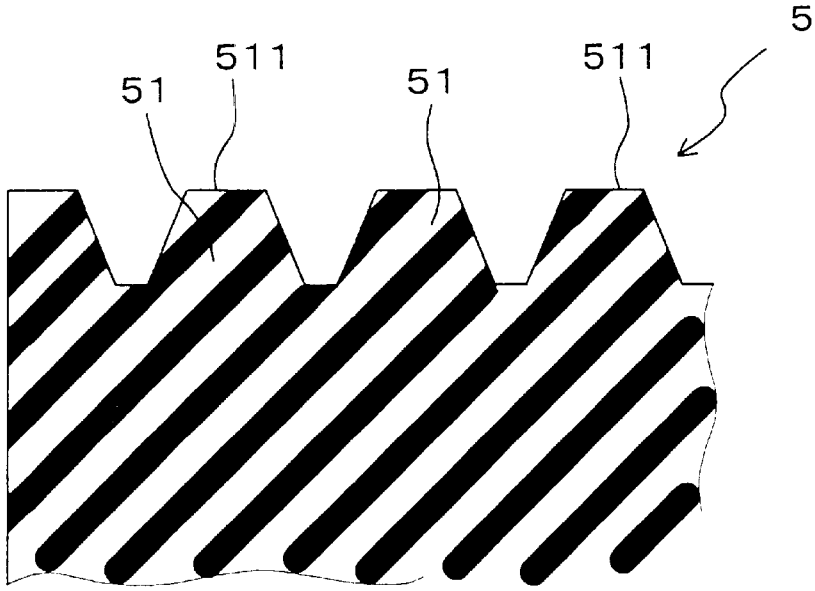

As illustrated in FIGS. 3A and 3B, each of the plurality of protruding portions 51 are of identical shape and of identical size and are further arranged at identical intervals.

The transfer roll 5 is arranged in that the number of protruding portions 51 formed per each inch of the roll surface is 65, and an area ratio of upper surfaces 511 of the protruding portions 51 of the roll surface is approximately 20%. The protruding portions 51 assume a height of approximately 450 $\mu$m.

The number of protruding portions 51 formed per each 2.54 cm of the roll surface is determined by counting the number of straight lines (slanted lines, broken line Y—Y of FIG. 3A), which are formed by successively formed protruding portions 51, existing between a width of 1 inch.

Further, the transfer roll 5 comprises an inner layer elastic portion 52 and an outer layer elastic portion 53 with a higher hardness than that of the inner layer elastic portion 52 as illustrated in FIG. 2. Both of the inner layer elastic portion 52 and the outer layer elastic portion 53 are made of rubber material, wherein the hardness of the inner layer elastic portion 52 is approximately 20 degrees while the hardness of the outer layer elastic portion 53 is approximately 70 degrees.

The dot-presenting paint 20 has a viscosity of approximately 0.025 Pa·s.

The dot-presenting paint 20 is of pale color while the undercoat of the designed surface 11 is gray-black.

Figure 4:
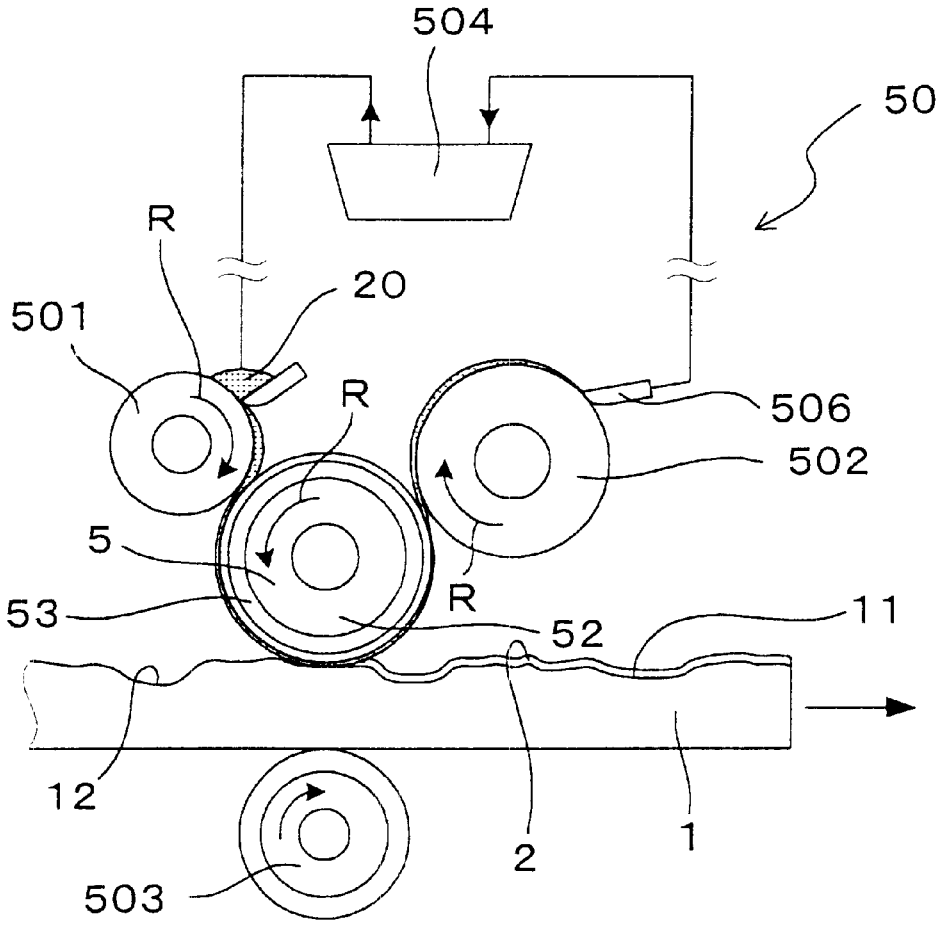
FIG. 4 is an explanatory view of a coating apparatus according to Embodiment 1.

A coating device 50 including the above-described transfer roll 5 as illustrated in FIG. 4 is employed for forming the dot-coating layer 2. More particularly, the coating apparatus 50 comprises the above transfer roll 5, an Anilox roll 501 for supplying the dot-presenting paint 20 to the transfer roll 5, a cleaning roll 502 for transferring dot-presenting paint 20 adhering on the surface of the transfer roll 5 to itself, and a backup roll 503 for supporting the building panel 1 between itself and the transfer roll 5.

The coating device 50 further comprises a paint tank 504 for supplying the dot-presenting paint 20 to the Anilox roll 501 as well as for receiving the dot-presenting paint 20 recovered by the cleaning roll 502. The dot-presenting paint 20 transferred to the cleaning roll 502 is removed from the cleaning roll 502 by a doctor blade 506, and is recovered to the paint tank 504.

Figure 5:
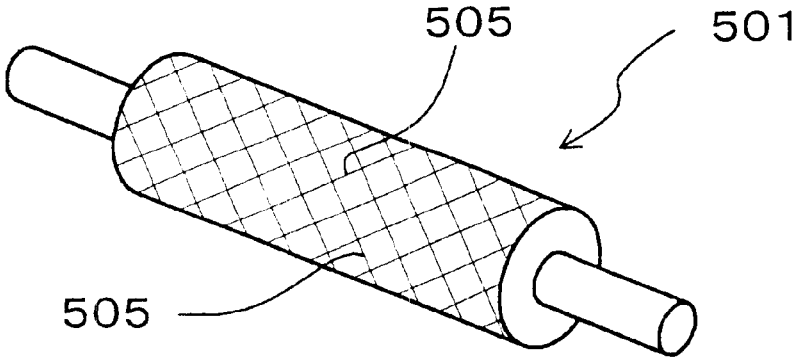
FIG. 5 is a perspective view of an Anilox roll according to Embodiment 1.

As illustrated in FIG. 5, the Anilox roll 501 is provided with mesh-like groove portions 505 formed on the surface thereof at angles of 45 with respect to the rotating direction. The groove portions 505 are formed at a number rate of 75 to 85 per inch and assume a depth of approximately 100 to 150 $\mu$m.

In case the number of groove portions 505 per inch is less than 75, a slanted linear pattern may happen to be formed on the designed surface. On the other hand, in case the number of groove portions 505 per 2.54 cm exceeds 85, the amount of coating may become insufficient.

The amount of coating may also become insufficient in case the depth of the groove portions 505 is less than 100 $\mu$m, while the amount of coating may become excessive when the depth of the groove portions 505 exceeds 150 $\mu$m.

For applying the dot-presenting paint 20 onto the building panel 1 through the coating device 50, the transfer roll 5, the Anilox roll 501, the cleaning roll 502 and the backup roll 503 are first rotated in a direction as indicated by the arrow R in FIG. 4. Thereafter, the dot-presenting paint 20 is supplied to the Anilox roll 501 from the paint tank 504.

In this manner, the dot-presenting paint 20 is supplied from the Anilox roll 501 to the transfer roll 5.

The building panel 1 is then made to pass through the transfer roll 5 and the backup roll 503 such that the designed surface 11 contacts the transfer roll 5.

In this manner, the dot-presenting paint 20 adhering on the surface of the transfer roll 5 is applied onto the designed surface 11.

Residues of the dot-presenting paint 20 adhering on the surface of the transfer roll 5 are recovered by being adhered on the surface of the cleaning roll 502 and are returned to the paint tank 504.

The actions and effects of the present embodiment will now be explained.

Figure 6A:
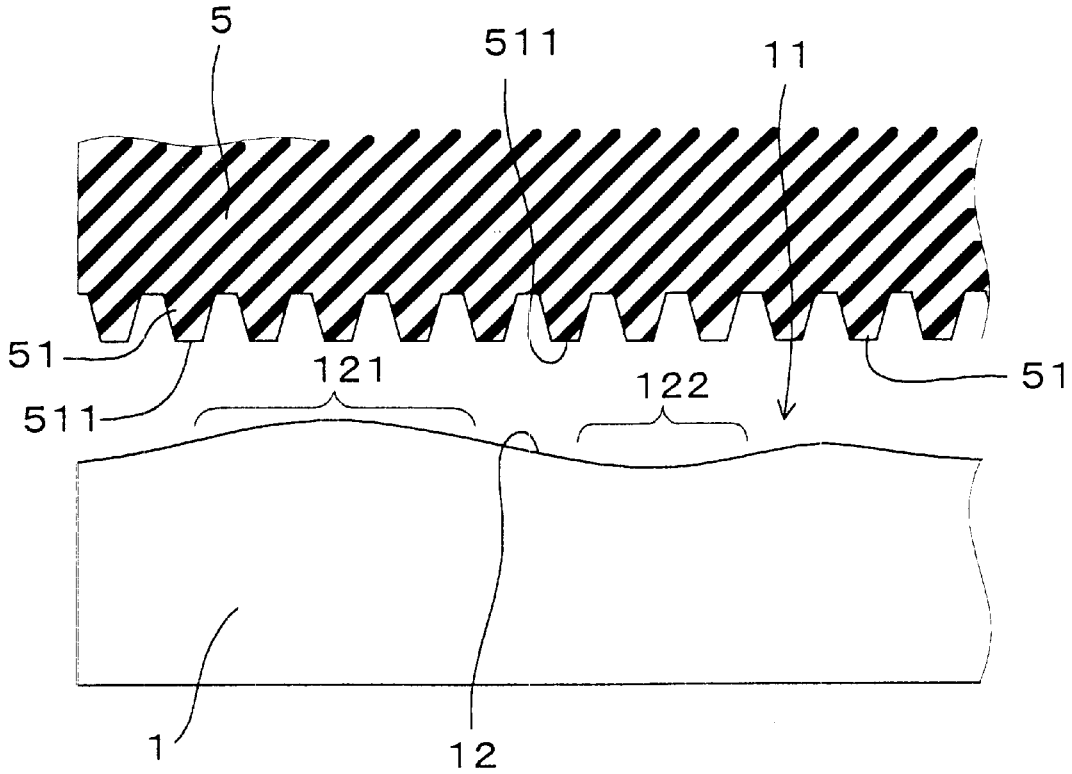
FIG. 6A is an explanatory view showing a condition before the transfer roll is pressurized against the designed surface of the building panel, and FIG. 6B an explanatory view showing a condition in which it has been pressurized thereto.
Figure 6B:
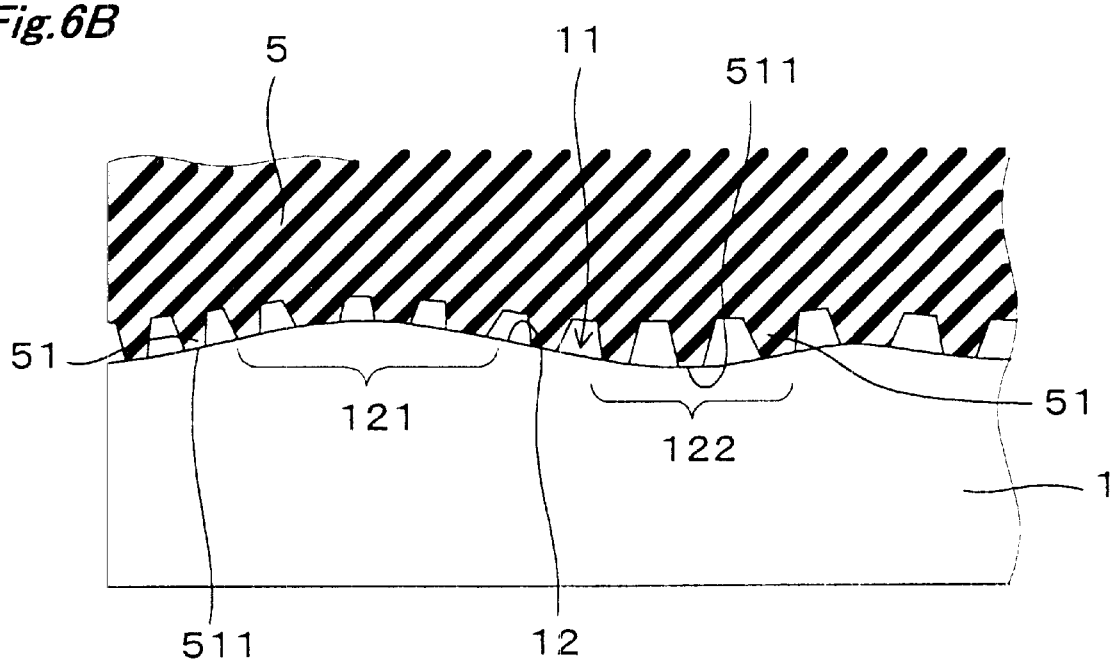

For forming the dot-coating layer 2 on the building panel 1, the dot-presenting paint 20 is applied while pressurizing the protruding portions 51, which are formed on the transfer roll 5 to assume identical shapes and sizes while being arranged at identical intervals, onto the designed surface 11 (FIGS. 6A and 6B). FIG. 6A is a view showing a condition before the transfer roll 5 is pressurized against the designed surface 11. FIG. 6B is a view showing a condition in which the transfer roll 5 is descended straightly down from the condition as illustrated in FIG. 6A and pressurized against the designed surface 11.

At this time, the pressurizing force applied by the protruding portions 51 onto the designed surface 11 differs between portions on the designed surface 11 since concave and convex portions 12 are formed on the designed surface 11. More particularly, the pressurizing force is large at convex portions 121 among the concave and convex portions 12 while the pressurizing force is small at the concave portions 122.

Thus, coating is performed in the present embodiment such that areas of the coated dots 21 are varied owing to the differences in pressurizing force. More particularly, the contact areas between the protruding portions 51 and the designed surface 11 vary owing to differences in pressurizing force whereby areas of the transferred coated dots 21 are accordingly varied as illustrated in FIG. 6B.

In other words, the pressurizing force being large at the convex portions 121, the contact areas between the protruding portions 51 and the designed surface 11 become large. On the other hand, the pressurizing force being small at the concave portions 122, the contact areas between the protruding portions 51 and the designed surface 11 become small.

With this arrangement, areas of the coated dots 21 become large at the convex portions 121 whereas areas of the coated dots 21 become small at the concave portions 122 (FIGS. 1A and 1B). Thus, the designed surface 11 assumes an external appearance with the color of the dot-presenting paint 20 being deep at the convex portions 121 while becoming gradually paler in approaching towards the concave portions 122.

More particularly, it is possible to achieve a gradational expression in which the convex portions 121 are bright as effected by the pale color of the dot-presenting paint 20 and in which the color becomes gradually deeper coming closer to the gray-black color of the undercoat in approaching the concave portions 122. With this arrangement, it is possible to enhance the concaves and convexes of the concave and convex portions 12 to obtain a designed surface 11 with satisfactory three-dimensional effects being imparted thereto.

According to the present embodiment, it is further possible to perform gradational expression by making the building panel 1 comprising concave and convex portions 12 on the designed surface 11 thereof pass along the transfer roll 5, thereby causing natural variations in the pressurizing force. It is thus possible to easily present three-dimensional effects while requiring no particular control for varying the pressuring force at respective portions.

The plurality of protruding portions 51 is formed to assume substantially identical shapes and sizes and are arranged at substantially identical intervals (FIGS. 3A and 3B). More particularly, owing to the substantially identical shapes and substantially identical sizes of the protruding portions 51, the differences in pressurizing force applied by the protruding portions 51 onto the designed surface 11 almost directly correspond to the differences in areas of the coated dots 21.

Since the protruding portions 51 are further arranged at substantially identical intervals, the large-sized areas of the coated dots 21 almost directly correspond to the deepening of the color of the dot-presenting paint 20 at the corresponding portions.

Thus, it is possible to reliably perform gradational expression in accordance with concave and convex portions of the designed surface 11 and to reliably present three-dimensional effects.

Since the transfer roll 5 is arranged in that the number of protruding portions 51 formed per each 2.54 cm of the roll surface thereof is 65, in that an area ratio of upper surfaces 511 of the protruding portions 51 within a 2.54 square centimeter of the roll surface is approximately 20%, and in that the protruding portions 51 assume a height of approximately 450 $\mu$m, it is possible to impart satisfactory three-dimensional effects to the designed surface 11 thereof through natural gradational expression.

The transfer roll 5 comprising the inner layer elastic portion 52 and the outer layer elastic portion 53, it is possible to reliably perform gradational expression in accordance with concave and convex portions 12 of the designed surface 11.

Further, the hardness of the inner layer elastic portion 52 being approximately 20 degrees and the hardness of the outer layer elastic portion 53 being approximately 70 degrees, it is possible to perform gradational expression in accordance with concave and convex portions 12 of the designed surface 11 in an even more reliable and uniform manner.

The viscosity of the dot-presenting paint 20 being approximately 0.025 Pa·s, coated dots 21 formed by transferring the dot-presenting paint 20 are maintained at transferred positions without flowing and also maintaining transferred sizes and shapes. Thus, it is possible to reliably exhibit desired three-dimensional effects on the designed surface 11 thereof.

As explained above, according to the present embodiment, it is possible to present a method for manufacturing a building panel capable of easily imparting satisfactory three-dimensional effects to a designed surface thereof that includes concave and convex portions.

Embodiment 2

As illustrated in FIGS. 7A to 7D and 8, the present embodiment is an example of a building panel and a method for manufacturing the same with a paint layer 3 being formed on its designed surface 11, the paint layer 3 comprising a four-layered paint layer of different colors including the dot-coating layer 2 as described in Embodiment 1.

Figure 7A:
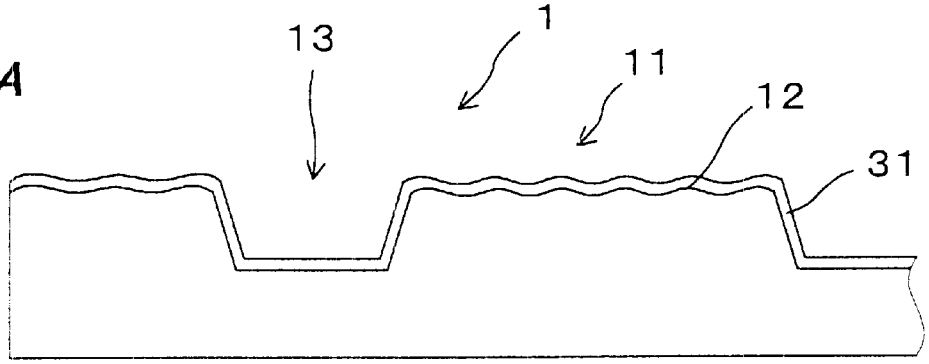
FIGS. 7A–7D are explanatory views showing a process of forming a paint layer according to Embodiment 2.
Figure 7B:
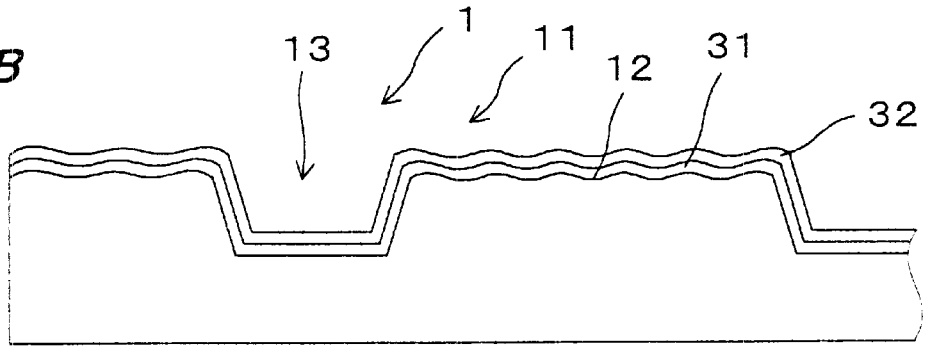
Figure 7C:
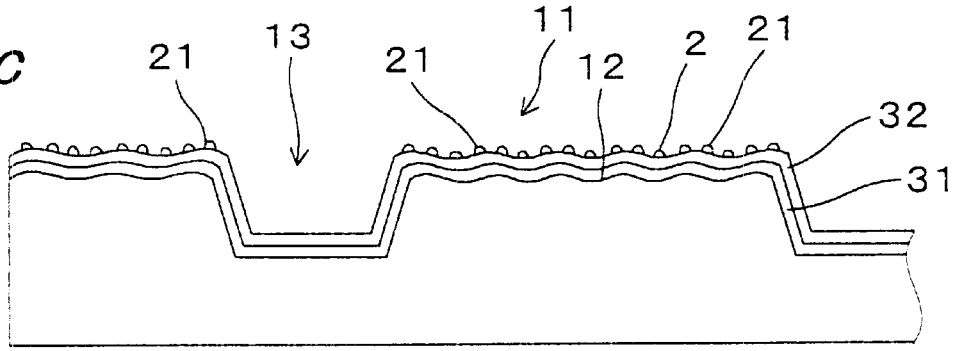
Figure 7D:
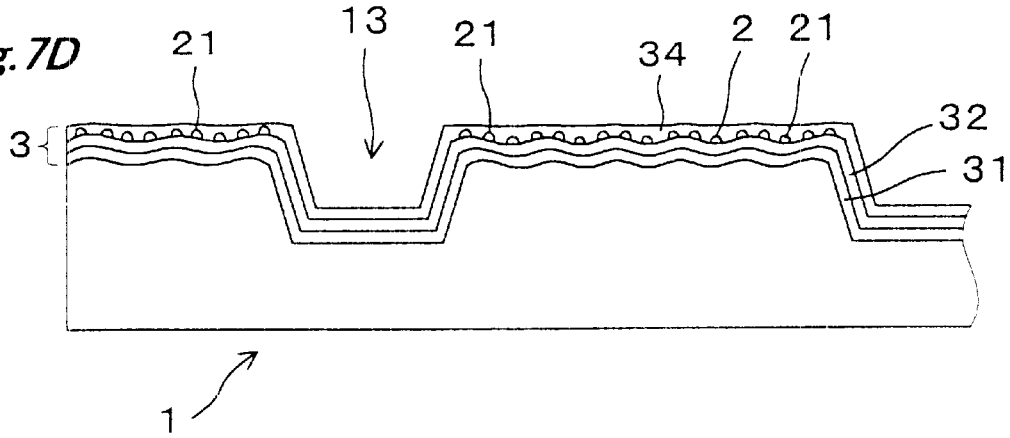
Figure 8:
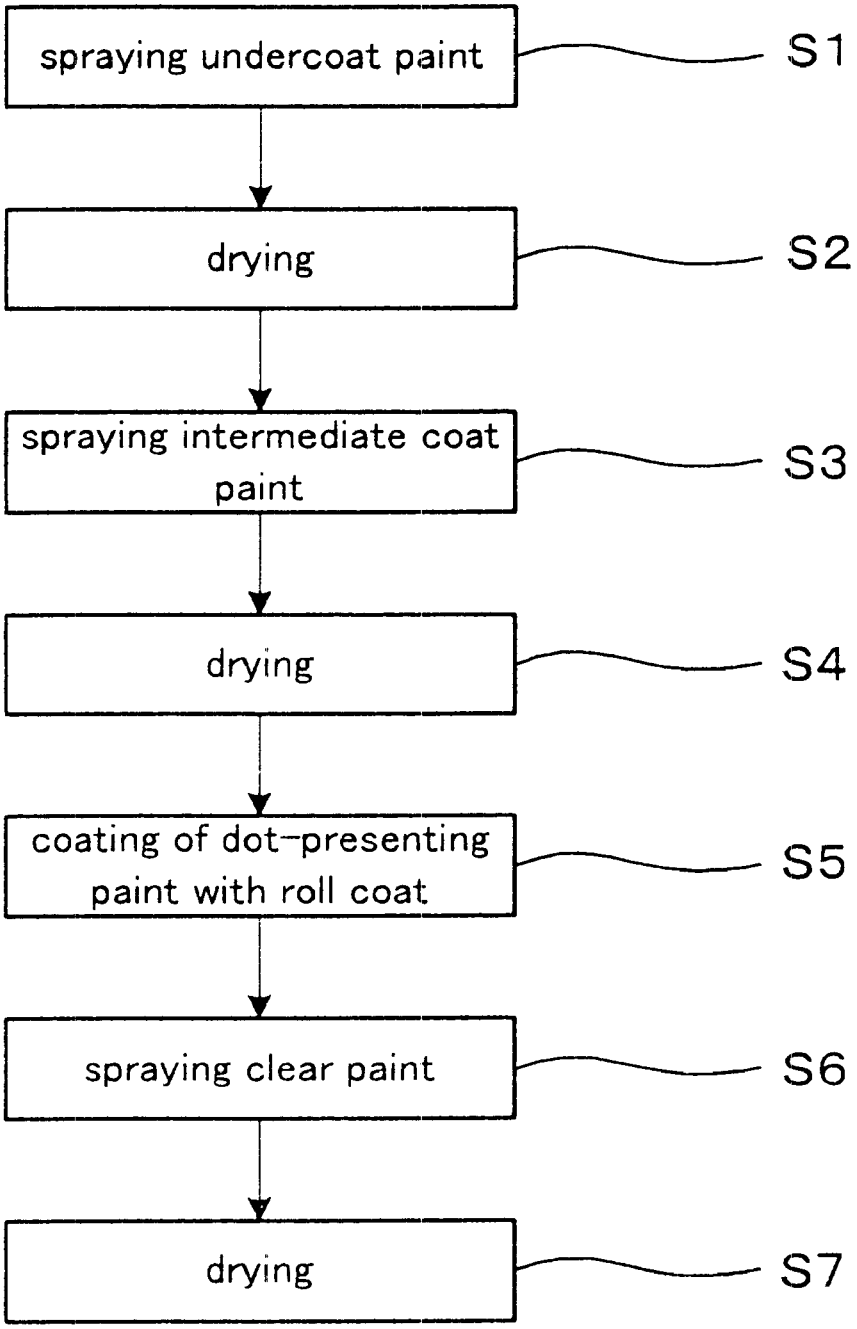
FIG. 8 is a flow chart showing the process for forming the paint layer according to Embodiment 2.

That is, the building panel 1 is formed of a paint layer 3 on its designed surface 11 as illustrated in FIG. 7D. More particularly, the paint layer 3 comprises an undercoat layer 31 and an intermediate coat layer 32 sequentially provided over the entire designed surface 11, a dot-coating layer 2 provided on the intermediate coat layer 32 at the concave and convex portions 12 of the designed surface 11, and a clear layer 34 provided on the entire surface of the designed surface 11.

The designed surface 11 comprises groove-like joint portions 13 as illustrated in FIGS. 7A to 7D. Remaining portions of the designed surface 11 other than the joint portions 13 comprise the concave and convex portions 12.

A method for forming the paint layer 3 on the designed surface 11 of the building panel 1 will now be explained with reference to FIGS. 7A to 7D and 8.

An undercoat paint is first sprayed over the entire designed surface 11 of the building panel 1 (Step S1). By drying this paint, an undercoat layer 31 is formed as illustrated in FIG. 7A (Step S2). Thereafter, intermediate coat paint 32 is sprayed onto the undercoat layer 31 (Step S3). By drying this paint, an intermediate coat layer 32 is formed as illustrated in FIG. 7B (Step S4). A dot-coating layer 2 is formed onto the intermediate coat layer 32 at the concave and convex portions 12 as illustrated in FIG. 7C by applying the dot-presenting paint 20 by utilizing the transfer roll 5 as described in the Embodiment 1 (Step S5). Then, a clear paint is sprayed over the entire surface of the designed surface 11 (Step S6). By drying this paint, a clear layer 34 is formed as illustrated in FIG. 7D (Step S7).

In this manner, the paint layer 3 is finished on the designed surface 11 of the building panel 1.

The color of the intermediate coat paint is gray-black and that of the dot-presenting paint 20 is a pale color.

In forming the dot-coating layer 2 in the process of forming the paint layer 3 (Step S5), the dot-presenting paint 20 is applied by using the transfer roll 5 as explained in the above Embodiment 1 through similar methods.

In this manner, it is possible to present three-dimensional effects through the intermediate coat layer 32 and the dot-coating layer 2. More particularly, gradational expression is achieved on the concave and convex portions 12 in which the color changes from a pale color to a gray-black color, extending from the convex portions 121 towards the concave portions 122. The concave and convex portions 12 are consequently enhanced through shading effects to thereby present three-dimensional effects.

Owing to the groove-like joint portions 13 of the designed surface 11, it is possible to obtain a building panel 1 with even superior three-dimensional effects being imparted to the designed surface 11 thereof.

Actions and effects similar to those of the Embodiment 1 can be achieved also in this embodiment.

Embodiment 3

As illustrated in FIGS. 9A to 9E and 10, the present embodiment is an example of a building panel and a method for manufacturing the same with a paint layer 30 being formed on its designed surface 11, the paint layer 30 comprises a five-layered paint layer of different colors including the dot-coating layer 2 as described in Embodiment 1.

The building panel 1 is formed with a paint layer 30 on its designed surface 11 as illustrated in FIGS. 9A to 9E. More particularly, the paint layer 30 comprises an undercoat layer 31 and an intermediate coat layer 32 sequentially provided over the entire designed surface 11, an upper coat layer 33 and a dot-coating layer 2 sequentially provided on the intermediate coat layer 32 at the concave and convex portions 12 of the designed surface 11, and a clear layer 34 provided on the entire surface of the designed surface 11.

A method for forming the paint layer 30 on the designed surface 11 of the building panel 1 will now be explained with reference to FIGS. 9A to 9E and 10.

An undercoat paint is first sprayed over the entire designed surface 11 of the building panel 1 (Step T1). By drying this paint, an undercoat layer 31 is formed as illustrated in FIGS. 9A to 9E (Step T2). Thereafter, intermediate coat paint is sprayed onto the undercoat layer 31 (Step T3).

Figure 9A:
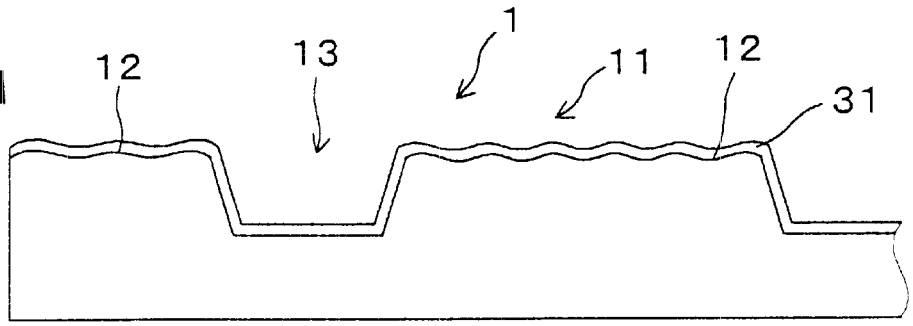
FIGS. 9A–9E are explanatory views showing a process of forming a paint layer according to Embodiment 3.
Figure 9B:
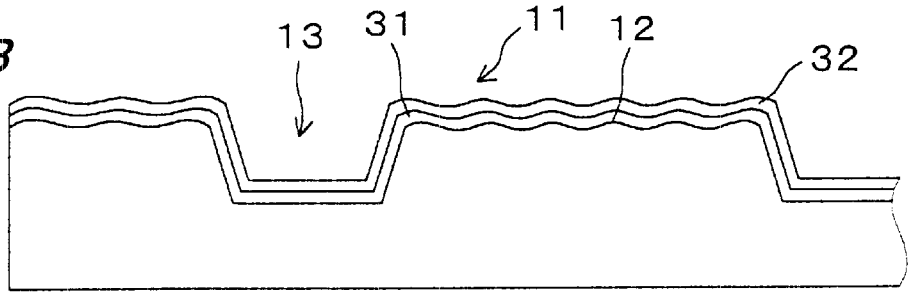
Figure 9C:
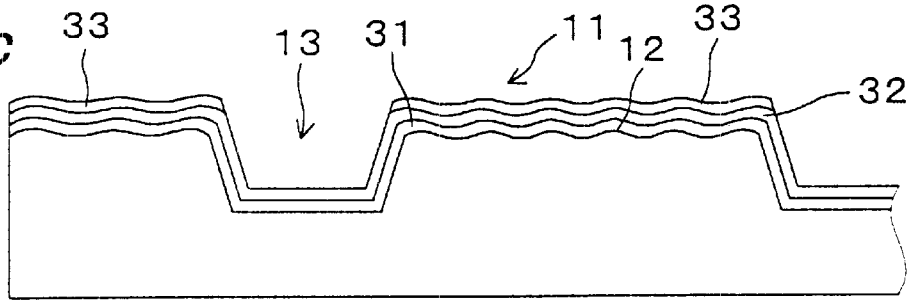
Figure 9D:
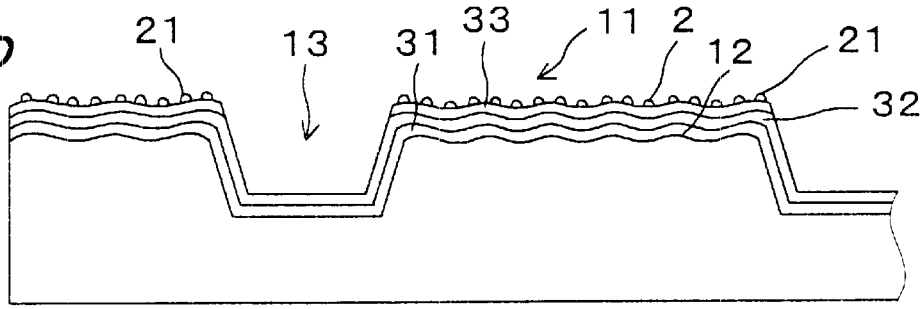
Figure 9E:
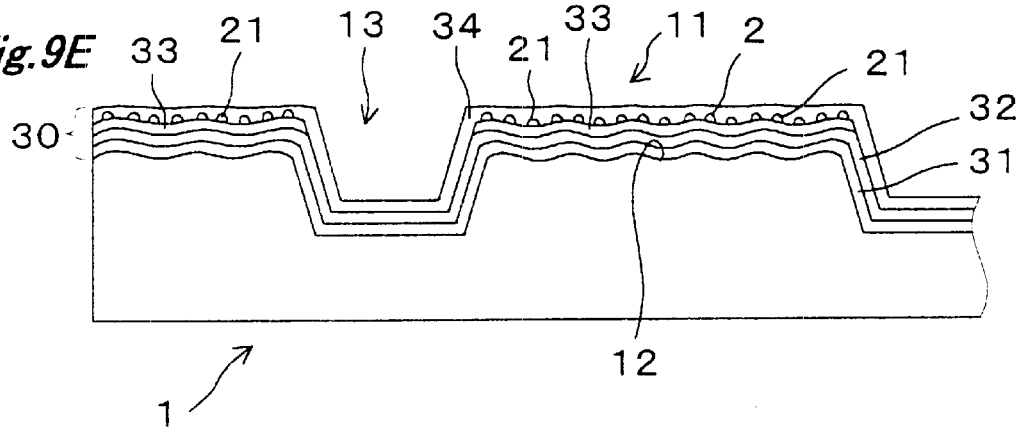
Figure 10:
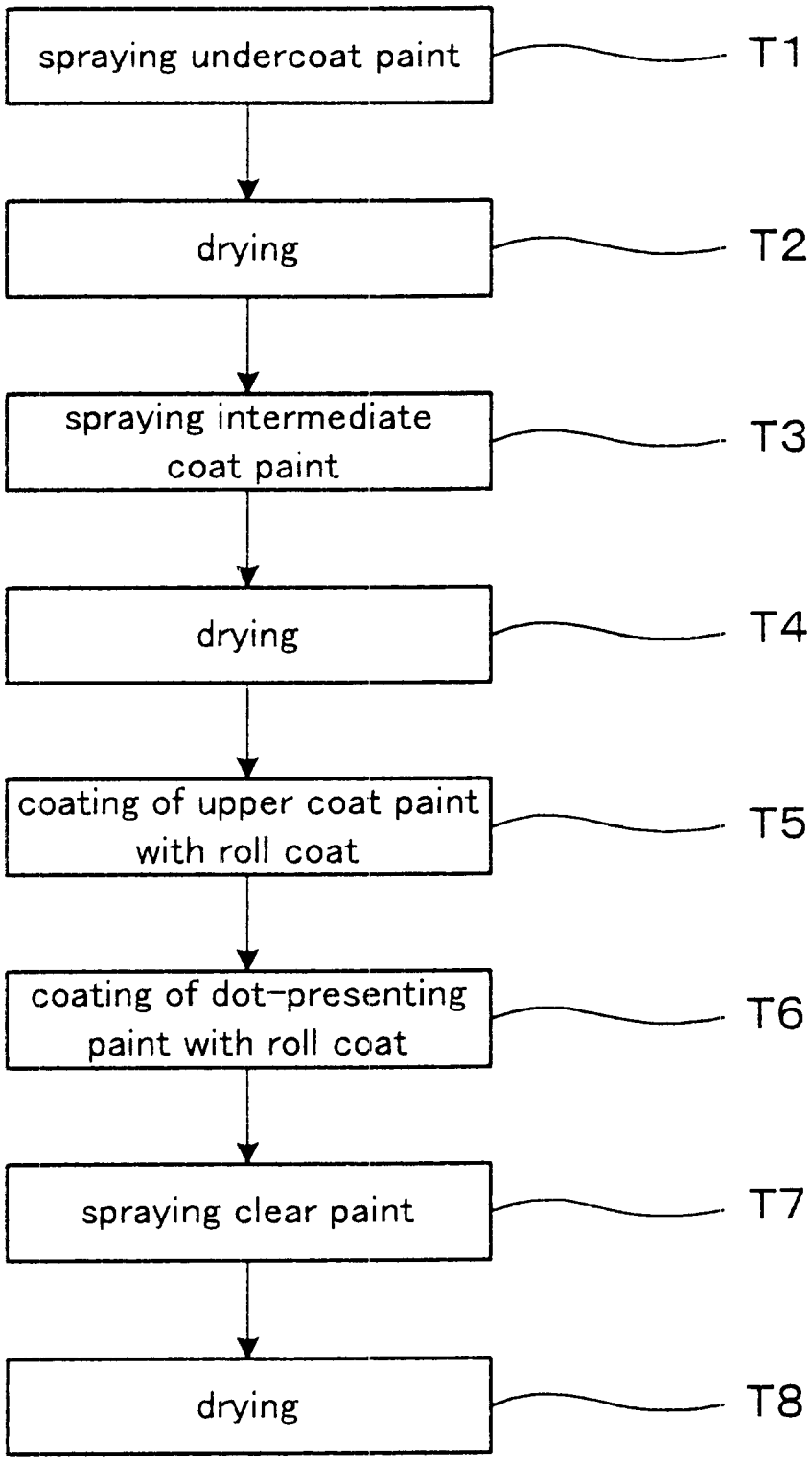
FIG. 10 is a flow chart showing the process for forming the paint layer according to Embodiment 3.

By drying this paint, an intermediate coat layer 32 is formed as illustrated in FIG. 9B (Step T4). Then, by forming an upper coat paint on the intermediate coat paint 32 at the concave and convex portions 12 through roll coating, an upper coat layer 33 is formed as illustrated in FIG. 9C (Step T5).

A dot-paint layer 2 is formed onto the upper coat layer 33 by applying dot-presenting paint 20 by utilizing the transfer roll 5 as described in the Embodiment 1 above (Step T6). Then, a clear paint is sprayed over the entire surface of the designed surface 11 (Step T7). By drying this paint, a clear layer 34 is formed (Step T8).

In this manner, the paint layer 30 is finished on the designed surface 11 of the building panel 1.

The color of the intermediate coat paint is gray-black, that of the upper coat paint an intermediately dense color, and that of the dot-presenting paint 20 a pale color.

In performing roll coating of the upper coat paint in the process of forming the paint layer 30 (Step T5), an ordinary coating roll with no particular protruding portions being formed on its roll surface is used. On the other hand, in forming the dot-coating layer 2 (Step T6), the dot-presenting paint 20 is applied by using the transfer roll 5 as explained in the above Embodiment 1 through similar methods.

In this manner, it is possible to present three-dimensional effects through the upper coat layer 33 and the dot-coating layer 2. More particularly, gradational expression is achieved on the concave and convex portions 12 in which the color changes from a pale color to an intermediately dense color, extending from the convex portions 121 towards the concave portions 122. The concaves and convexes of the concave and convex portions 12 are consequently enhanced through shading effects to thereby present three-dimensional effects.

The designed surface 11 comprises the groove-like joint portions 13 wherein the joint portions 13 exhibit a gray-black color, this being the color of the intermediate coat paint. Thus, it is possible to obtain a building panel 1 with even superior three-dimensional effects being imparted to the designed surface 11 thereof through shading effects of three colors.

Actions and effects similar to those of the Embodiment 1 can be achieved also in this embodiment.

While the invention has been described with reference to embodiments, it is to be understood that modifications or variations may be easily made by a person of ordinary skill in the art without departing from the scope of the invention which is defined by the appended claims.

What is claimed is:

1. A method for manufacturing a building panel obtained by forming a dot-coating layer on a designed surface thereof that includes concave and convex portions, the method comprising the steps of:

transferring a dot-presenting paint onto the designed surface for forming a plurality of dots via a transfer roll formed with a plurality of protruding portions on a roll surface of the transfer roll in order to form the dot-coating layer, wherein the plurality of dots are formed so that areas of the dots are varied through differences in pressurizing force applied by the protruding portions onto the designed surface.

2. The method for manufacturing a building panel according to claim 1, wherein the plurality of protruding portions are of substantially identical shape and of identical size and are further arranged at substantially identical intervals.

3. The method for manufacturing a building panel according to claim 1, wherein the number of protruding portions formed per inch on the roll surface is 60 to 70, wherein an area ratio of upper surfaces of the protruding portions is 15 to 25% of the roll surface, and wherein a height of the protruding portions is 400 to 500 $\mu$m.

4. The method for manufacturing a building panel according to claim 1, wherein the transfer roll comprises an inner layer elastic portion and an outer layer elastic portion with a hardness higher than a hardness of the inner layer elastic portion.

5. The method for manufacturing a building panel according to claim 4, wherein the hardness of the inner layer elastic portion is 15 to 25 degrees and the hardness of the outer layer elastic portion is 65 to 75 degrees.

6. The method for manufacturing a building panel according to claim 1, wherein the dot-presenting paint has a viscosity of 0.02 to 0.03 Pa·s.

7. The method for manufacturing a building panel according to claim 1, wherein the designed surface comprises grooved joint portions.

8. The method for manufacturing a building panel according to claim 1, wherein prior the step of transferring the dot-presenting paint onto the designed surface to form the dot-coating layer, an undercoat layer and an intermediate coat layer are formed over an entire surface of the designed surface via the steps of:

forming the undercoat layer by spraying an undercoat paint over the entire surface of the designed surface of the building panel; and forming the intermediate coat layer by spraying an intermediate coat paint on the undercoat layer;

wherein the step of transferring the dot-presenting paint onto the designed surface to form the dot-coating layer includes forming the dot-coating layer by applying the dot-presenting paint on the intermediate coat layer at the concave and convex portions by using the transfer roll; and wherein after the step of transferring the dot-presenting paint onto the designed surface to form the dot-coating layer is performed, forming a clear layer by spraying a clear paint on the entire surface of the designed surface.

9. The method for manufacturing a building panel according to claim 7, wherein prior the step of transferring the dot-presenting paint onto the designed surface to form the dot-coating layer, an undercoat layer and an intermediate coat layer are formed over an entire surface of the designed surface and an upper coat layer is formed at the concave and convex portions via the steps of:

forming the undercoat layer by spraying an undercoat paint over the entire surface of the designed surface of the building panel;

forming the intermediate coat layer by spraying an intermediate coat paint on the undercoat layer; and forming the upper coat layer by applying an upper coat paint on the intermediate coat layer at the concave and convex portions through roll coating;

wherein the step of transferring the dot-presenting paint onto the designed surface to form the dot-coating layer includes forming the dot-coating layer by applying the dot-presenting paint on the upper coat layer by using the transfer roll; and wherein after the step of transferring the dot-presenting paint onto the designed surface to form the dot-coating layer is performed, forming a clear layer by spraying a clear paint on the entire surface of the designed surface.

* * * * *